US007654426B2

(12) United States Patent
Eberle

(10) Patent No.: US 7,654,426 B2
(45) Date of Patent: Feb. 2, 2010

(54) BACKPACK WITH INCORPORATED GUN SCABBARD

(76) Inventor: Glen Richard Eberle, 2410 Hillway Dr., Boise, ID (US) 83702

( * ) Notice: Subject to any disclaimer, the term of this patent is extended or adjusted under 35 U.S.C. 154(b) by 382 days.

(21) Appl. No.: 10/894,293

(22) Filed: Jul. 19, 2004

(65) Prior Publication Data

US 2005/0000995 A1 Jan. 6, 2005

Related U.S. Application Data

(63) Continuation-in-part of application No. 10/355,495, filed on Jan. 31, 2003, now Pat. No. 6,763,987.

(51) Int. Cl.
*A45F 3/04* (2006.01)

(52) U.S. Cl. ..... 224/637; 224/652; 224/653; 224/913

(58) Field of Classification Search ..... 224/149, 224/272, 232, 251
See application file for complete search history.

(56) References Cited

U.S. PATENT DOCUMENTS

| | | | | |
|---|---|---|---|---|
| 4,693,402 | A | 9/1987 | Comeau | 224/215 |
| 4,754,904 | A | 7/1988 | Fischer et al. | 224/259 |
| D311,813 | S | 11/1990 | Oliver | D3/32 |
| 5,016,793 | A | 5/1991 | Derkatz | 224/209 |
| 5,573,166 | A | 11/1996 | Leja | 224/630 |
| 5,664,721 | A | 9/1997 | Homeyer | 224/651 |
| 5,669,170 | A | 9/1997 | Norris | 42/85 |
| 5,806,742 | A | 9/1998 | Mott et al. | 224/645 |
| 5,961,017 | A * | 10/1999 | Mehler | 224/576 |
| 6,152,338 | A | 11/2000 | Smith | 224/149 |
| 6,179,188 | B1 | 1/2001 | Gleason | 224/641 |
| 6,185,738 | B1 | 2/2001 | Sidebottom | 2/2.5 |
| 6,196,437 | B1 * | 3/2001 | Smith, III | 224/629 |
| 6,367,674 | B1 | 4/2002 | Tabor | 224/650 |
| 6,520,390 | B2 | 2/2003 | Verdugo et al. | 224/150 |
| 2004/0173655 | A1 * | 9/2004 | Markson | 224/638 |

* cited by examiner

*Primary Examiner*—Gary E Elkins
(74) *Attorney, Agent, or Firm*—Robert L. Shaver; Dykas, Shaver & Nipper, LLP

(57) ABSTRACT

A method of forming a backpack with an integral gun scabbard has been devised whereby the user has a convenient place for the storage and carriage of a rifle, shotgun, or other long gun type of firearm, and simultaneously can store and carry a variety of other sundry cargo while moving about. The backpack is devised in such a way as to permit easy and rapid access to and retrieval of said firearm from the storage. It is equipped with dual padded shoulder straps. In an ideal embodiment, a waist belt is included to facilitate the stabilization of the scabbard when the firearm is being withdrawn, as well as to contribute to the load bearing functions of the backpack.

17 Claims, 9 Drawing Sheets

BACKPACK WITH INCORPORATED GUN SCABBARD

CROSS-REFERENCE TO RELATED APPLICATIONS

This Specification is a Continuation in Part of application Ser. No. 10/355,495, Filing Date Jan. 31, 2003 now U.S. Pat. No. 6,763,987, Inventor Glen Richard Eberle, titled Backpack with Incorporated Gun Scabbard.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The present invention relates to backpacks. In particular, the present invention relates to a backpack which is designed to have the dual utility of carrying a long barreled firearm as well as a load of varied cargo, and furthermore allows rapid access to and use of said firearm without removal of the backpack from the user's back. This combined capability is most useful for the activity of hunting, wherein a user will often be carrying some sort of backpack filled with the sundries necessary to the outing, and simultaneously carrying a long gun type of firearm. These latter are often fitted with a single strap or sling, which permit them to be slung over a user's shoulder in order to relieve the user's hands of a constant burden. It can readily be imagined that the shoulder straps and bulk of a backpack generally cause direct interference with the carriage of a long gun over one's shoulder. There have been some attempts to address this problem, with varying degrees of success. A common handicap in the prior art is that the mechanisms devised for attaching a firearm to a backpack generally require the removal of the backpack from the wearer's back in order to detach the firearm from its carriage. In hunting, it is frequently necessary to have quick and ready access to one's firearm, and products in the prior art do not facilitate this.

It is further presented that for purposes of safety as well as for the purpose of the protection of valuable firearms while actively hiking while hunting, it is necessary and beneficial to have the firearm enveloped in some type of protective surround whereby passing branches won't protrude into the firing mechanism of the firearm, and also won't be permitted to scratch and mar the finish of the gunstock, which is frequently made of wood.

Another obstacle in the art is that most rifles, shotguns, and other long gun firearms are of sufficient length that they are generally an encumbrance to activity regardless of where they are stowed. If they are attached to a backpack, they often will stick up too high and thereby snag overhead branches as the wearer passes under. If they are too low, they tend to bump and collide with the user's legs, or to hit logs, rocks, and the like that the user is stepping over.

There is a long history and variety of backpacks and related devices for carriage of loads upon the human back, and the prior art is widely explored, known, and developed. Their size and dimension ranges from a small, compact variety known as daypacks, such as disclosed in U.S. Pat. No. 5,573,166 to Leja, to larger packs designed for carrying heavier and more bulky loads such as disclosed in U.S. Pat. No. 6,179,188 to Gleason. Any and all of these will cause the aforementioned interference with the carriage of a long gun.

There is similarly a long and varied history of means and mechanisms for carriage of long guns, some of which include some type of backpack-based storage. Most often, a variety of straps are used to attach a gun either to a simple platform as disclosed in U.S. Pat. No. D311,813 to Oliver, U.S. Pat. No. 4,754,904 to Fischer, et al., or similar strap combinations might be used to attach a firearm to a backpack. These varieties typically require the manipulation of a number of straps both to attach and to remove the firearm from the carriage, thus being examples of devices that are not well suited to the active pursuit of game. Similar devices are disclosed in U.S. Pat. No. 5,664,721 to Homeyer, and U.S. Pat. No. 5,669,170 to Norris.

Other devices have been developed which attempt to maintain the firearm in a ready position while relieving one's hands of the constant burden of carriage, as for example disclosed in U.S. Pat. No. 6,152,338 to Smith, wherein straps and a spatula type of structure are used to support a firearm in a carriage position forward of the user's shoulders. While this device may serve to function in combination with a backpack and does place the firearm in a position of ready access, it does not provide a protective surround for the firearm. Further, if while using a device of this variety a user came across game, he would still have to unfasten one or more straps in order to have free use of his firearm. In addition, it may be felt that having the firearm positioned forward of the shoulder places it in a position of obstruction and causes interference with one's activities.

Examples in the prior art which attempt to address carriage of a long gun in a manner that either protects it or positions it out of a user's way generally do not permit the simultaneous carriage of a backpack or load other than the firearm. For instance, as disclosed in U.S. Pat. No. 5,016,793 to Derkatz, the firearm is to be housed in a standard scabbard, which has been fitted with shoulder straps for carriage. In this case, there is no provision for carriage of an additional load, such as a hunter would typically need in a day's outing, nor is the described harness sufficient to comfortably carry significant cargo. The device as disclosed could not be fitted with significant cargo carrying capacity, and further would preclude the carriage of a backpack or waist pack. Another example is disclosed in U.S. Pat. No. 5,806,742 to Mott, et al., wherein a described gun case is fitted with backpack style shoulder straps. While this device is suitable for the transportation of a firearm, it would not be suitable for active hunting, as the case is designed to be of flexible construction, which causes it not to function as a scabbard, since the flexible cloth will act as an impediment to the rapid withdrawal of the firearm. In addition, it is fitted with a cover flap and closure strap, which obviate that it is not designed for the rapid removal of the contents. Further, this device is designed without the intent of bearing a load greater than the firearm and some small associated items such as ammunition, does not provide for the storage capacity of any type of backpack, and precludes the simultaneous use of a separate backpack.

There are examples of backpacks that have been designed to carry a combination of sundries and some sort of bulky elongated article, such as disclosed in U.S. Pat. No. 4,693,402 to Comeau and U.S. Pat. No. 6,367,674 to Tabor. These are generally light duty and are not designed or apparently envisioned with the mechanical and physical attributes necessary for the carriage of a long gun type of firearm.

It can readily be appreciated that in the sport of hunting, participants frequently range far afield on foot, and often desire to carry in a backpack a range of goods necessary to the outing. These can include camping gear, survival equipment, inclement weather gear, water, and food stocks, as well as the sundries devoted to the sport of hunting. This gear and these packs can be quite bulky, and as previously shown can interfere with the traditional over-the-shoulder sling carriage of a long gun. It can further be imagined that when climbing hills, passing through thick brush, and the like, the use of both hands is desirable, and that for reasons of safety, convenience, and the relief of fatigue, it is desirable to stow one's firearm in a place that keeps it safe and out of the way, but still maintains it in a ready position in the event that one has an unexpected encounter with game.

It is submitted that the present invention substantially meets these needs, and is a new, original, and unique departure from the prior art, and that it will be embraced with enthusiasm by those avid participants in the sport of hunting who prefer to hike about on their feet.

BRIEF SUMMARY OF THE INVENTION

The present invention is a backpack which is capable of simultaneously carrying a load of miscellaneous cargo and a long gun type of firearm. A primary object of the invention is to present a backpack of true dual utility, which will be capable of carrying significant loads of cargo and which provides a solution to the problem of where to stow a long gun on one's person while one is carrying a backpack. More specifically, a backpack is presented which has two shoulder straps, which extend from the top of the pack forward over the shoulders of a user, and then return on either side of the waist to reattach at the lower part of the backpack. In the preferred embodiment, these straps are padded on their upper portion in order to make the pack more comfortable for the wearer, and are fitted with a means of making them adjustable in length. Also in the preferred embodiment, a waist belt is included for the dual purposes of adding to the load bearing capabilities of the backpack, and to stabilize the lower portion of the pack in order to facilitate the rapid withdrawal of the firearm from its housing. Preferably, this waist belt is of heavy-duty construction, is padded for comfort, is wide nearest the main panel of the backpack, and tapers in a symmetrical fashion as it develops forward toward an adjustable and releasable closure. The backpack is sized in such a manner that the whole of the primary structure, which uses a generally rectangular panel as its foundation, fits most users in a way that its bottom extent ends just above the buttocks, and the top rises to the level of the top of the user's shoulders. This latter dimension is important because it permits the user to reach over his shoulder, and to grasp and withdraw the firearm from its housing, without removing the backpack. Alternative embodiments are meant to be encompassed by this disclosure.

The storage compartments of the backpack are of two diverse types. Firstly, a scabbard is provided, which in the ideal embodiment is of semi-rigid construction to facilitate easily inserting and rapidly removing a firearm, and is a long, tapered, hollow sheath with an open top which is sized such that it fits most long gun type firearms, including scoped rifles and shotguns. One of the objects of the invention is to present a device which allows the rapid and ready retrieval of one's long gun from its storage in the event it is needed. To accomplish this, the top of the scabbard is approximately flush with the top of the main panel of the backpack, which is in turn approximately level with the top of the wearer's shoulders, thereby permitting the user to easily reach over his shoulder and grasp the butt stock or the pistol grip of the firearm for its withdrawal. Of primary importance in the relationship of the scabbard to the main panel is the resultant positioning of the firearm relative to the user's shoulders. Alternative embodiments can place the top of the scabbard lower or higher than the top of the main panel, but still position the firearm such that it can be grasped by reaching over the shoulder, and these alternatives are meant to be encompassed by this disclosure. It is likewise important that the scabbard be positioned with a minimum of space between it and the user's back, so that one doesn't have to reach overly far back to grasp the firearm. Of final importance in sizing the scabbard is to make it sufficient of length to house a standard long gun's barrel, sights, action, trigger assembly, and fore-stock up to the approximate position of its pistol grip, but it must not be made of such a great length that it protrudes overly far below the bottom level of the backpack in order that it not become an encumbrance to activity. In the preferred embodiment, this scabbard is fixedly attached, plan form, to the main panel of the backpack. It is oriented vertically, with the top approximately even with the top of the main panel and the bottom protruding below the bottom extent of the main panel, and fills approximately half of the lateral space of the front side of the main panel. In an alternative embodiment, the scabbard can be rotated as much as ninety degrees away from the plan form. By using this configuration, the scabbard can be moved to the side of the main compartment of the backpack, thereby freeing more space in the pack for conventional storage compartments. A second alternative embodiment utilizes the scabbard as a broad intervening layer between the main panel and the cargo compartments of the backpack. In this variant, the scabbard fills all or the majority of the plan form space of the main panel, and cargo compartments are overlaid. A third alternative embodiment includes a wedge shaped spacer between the scabbard and the main panel. This wedge can be in the form of a separate storage compartment, or induced by a spacer in the lower portion of the pack, or some similar arrangement. The wedge modifies the basic invention by orienting the scabbard in such a way as to cause the firearm to project forward over the user's shoulder, thereby making it easier to grasp and withdraw the firearm.

The second type of storage compartment is comprised of a generally six sided, box type construction, is made of fabric, and has an orifice with a zipper, clasp, or like closure, and is similar to conventional cargo compartments on backpacks of the prior art. In the present preferred embodiment, a cargo compartment is fixedly attached to the front side of the main panel of the backpack, adjacent to the scabbard, and filling the remaining lateral space. In a preferred embodiment, it is of a similar thickness to the scabbard, thereby filling approximately the same volume of space above the main panel of the backpack. By constructing both the scabbard and first cargo compartment of the same thickness, a uniform layer in the backpack is formed which facilitates placing a uniformly dimensioned larger cargo compartment outside these first storage units. This larger compartment is also generally a six sided, sewn fabric, box type construction, with an orifice and a releasable closure therefore. In an alternative embodiment, the first storage compartment can be made of a greater depth than the scabbard, thereby giving it substantial storage volume, and the larger overlaid compartment can be foregone. Other embodiments, with varying scabbard orientations, may be configured with conventional cargo compartments such as those here described, with the size, geometric shape, and placement of the cargo compartments varied in order to fill the volume of cargo storage space desired for the particular backpack. It can readily be seen that all of these described standard cargo compartments may be further internally subdivided, with provision made for individual access to, and selective closure for, each of the storage cells thereby formed, without substantially altering the intent or scope of the invention. It can similarly be seen that the size and orientation of the cargo compartments can be varied and altered in the manner common to load bearing backpacks in the prior art, without substantially altering the intent or scope of the invention.

The advantages of this invention over the prior art arise from the fact that this backpack is intended to be of full and simultaneous use both as a cargo carrying backpack, and as a device for safely, efficiently, comfortably, and conveniently carrying a long gun. Furthermore, it is intended to be of use to one who is actively engaged in hiking while hunting or a similar activity, thereby leaving both hands, at least one of which would otherwise be holding or stabilizing a gun, free to assist in balance, climbing, holding away branches, and the like. The present invention offers the further advantage of providing easy and rapid access to the user's firearm. When it is necessary, there is minimum delay in having the gun unsheathed and moved to a firing position. Furthermore this action can be accomplished without removing the backpack from one's back. Lastly, by enclosing the majority of the firearm in a protective envelope and housing it aft of one's shoulders, there will be improvements in the protection of the firearm, and safety advantages in having the trigger, gun safety, and firing mechanism enclosed while one is traveling through and about protruding branches and the like.

It is presented that one reason that examples similar to this invention are not found in the prior art is because the mechanical and physical proportions of the present invention are not obvious. The present invention offers a dual utility backpack, which serves all of the functions of a standard backpack and has the added benefits and conveniences resulting from the careful incorporation of a gun scabbard. It can be seen that the present invention is an entirely unique, new, and useful departure from all that has been accomplished in the prior art.

DETAILED DESCRIPTION OF THE INVENTION

Figure 1:
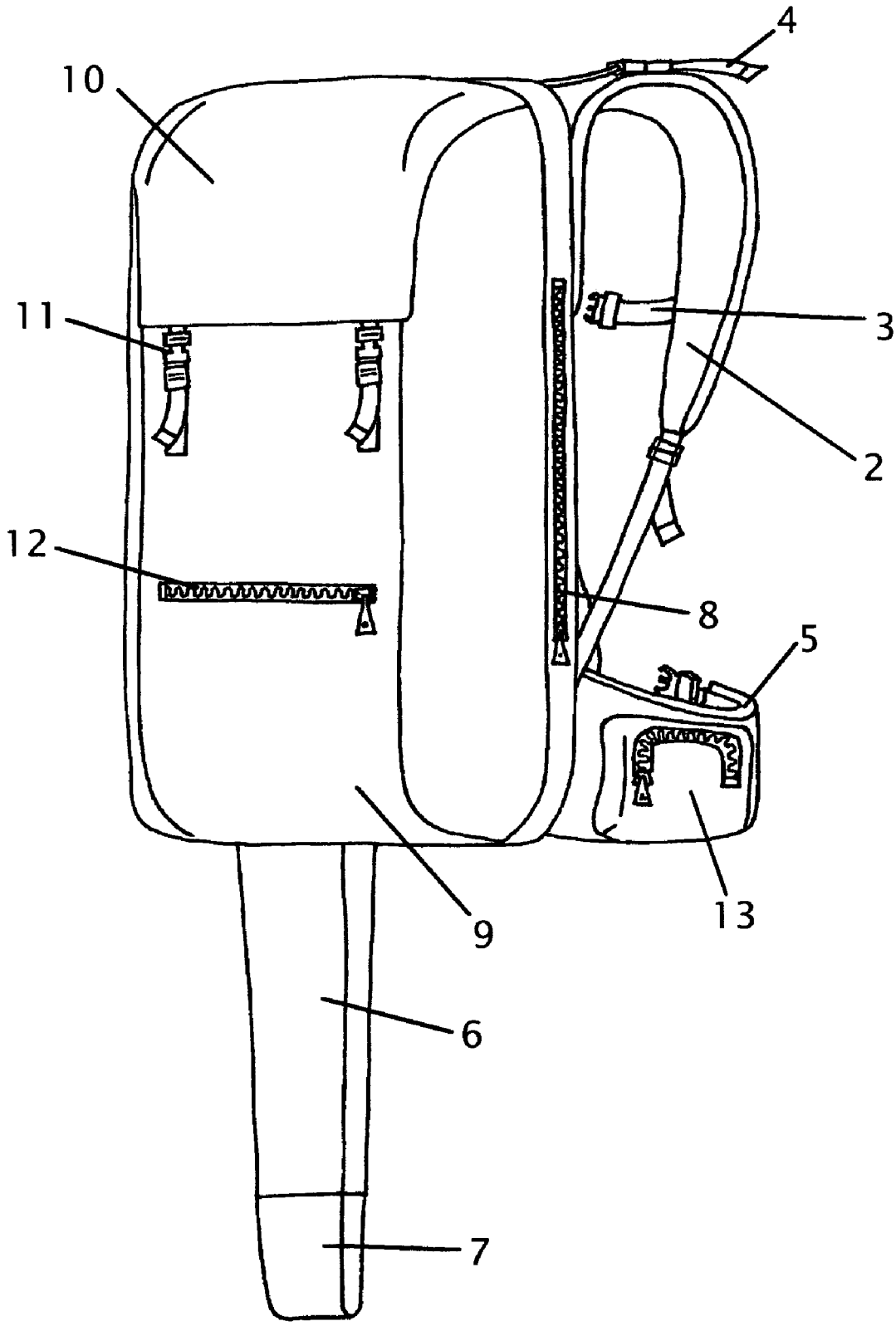
FIG. 1 is a right front quarter perspective view of a preferred embodiment of the invention.
Figure 2:
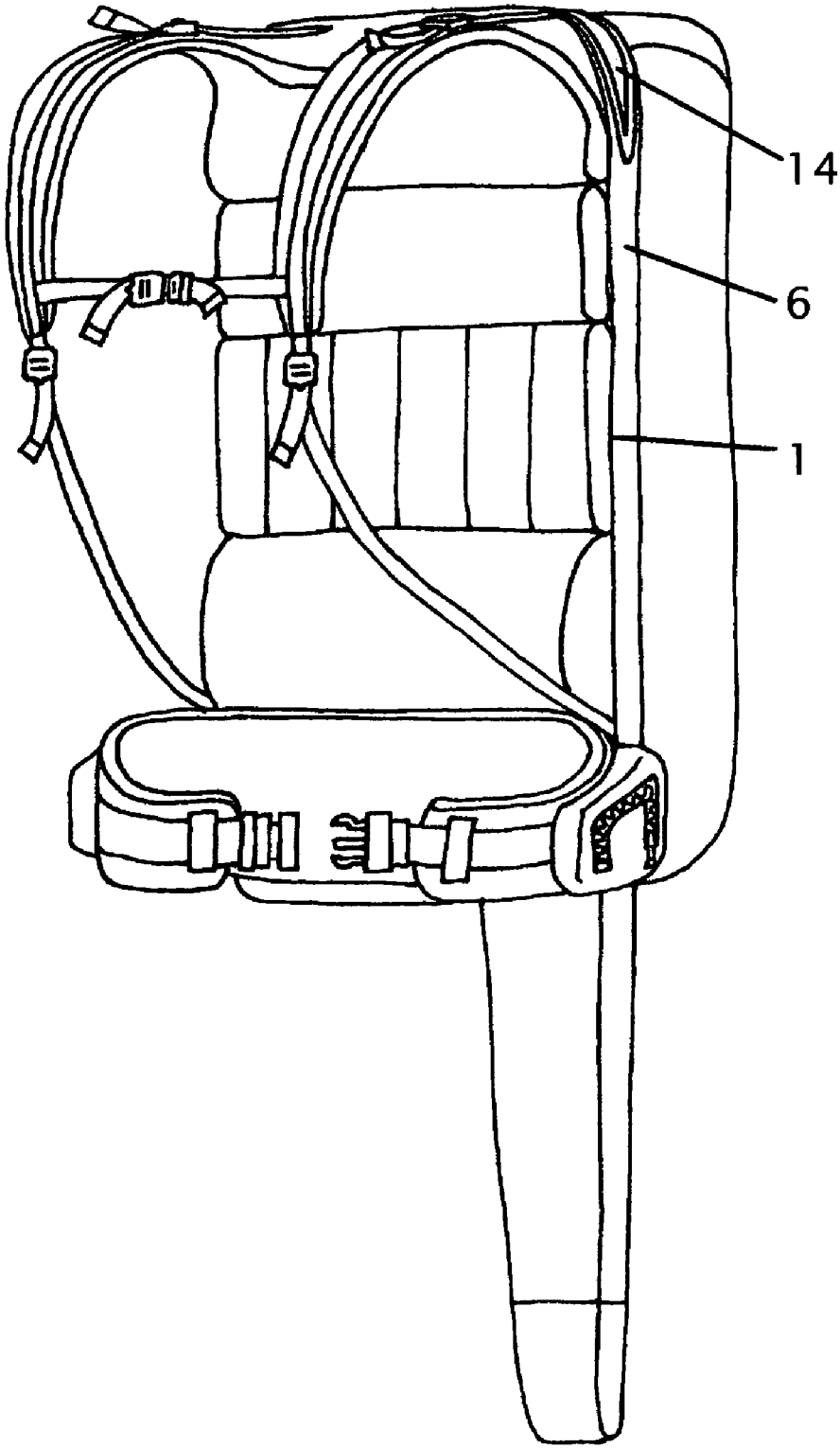
FIG. 2 is a left rear quarter perspective view of a preferred embodiment of the invention.
Figure 5:
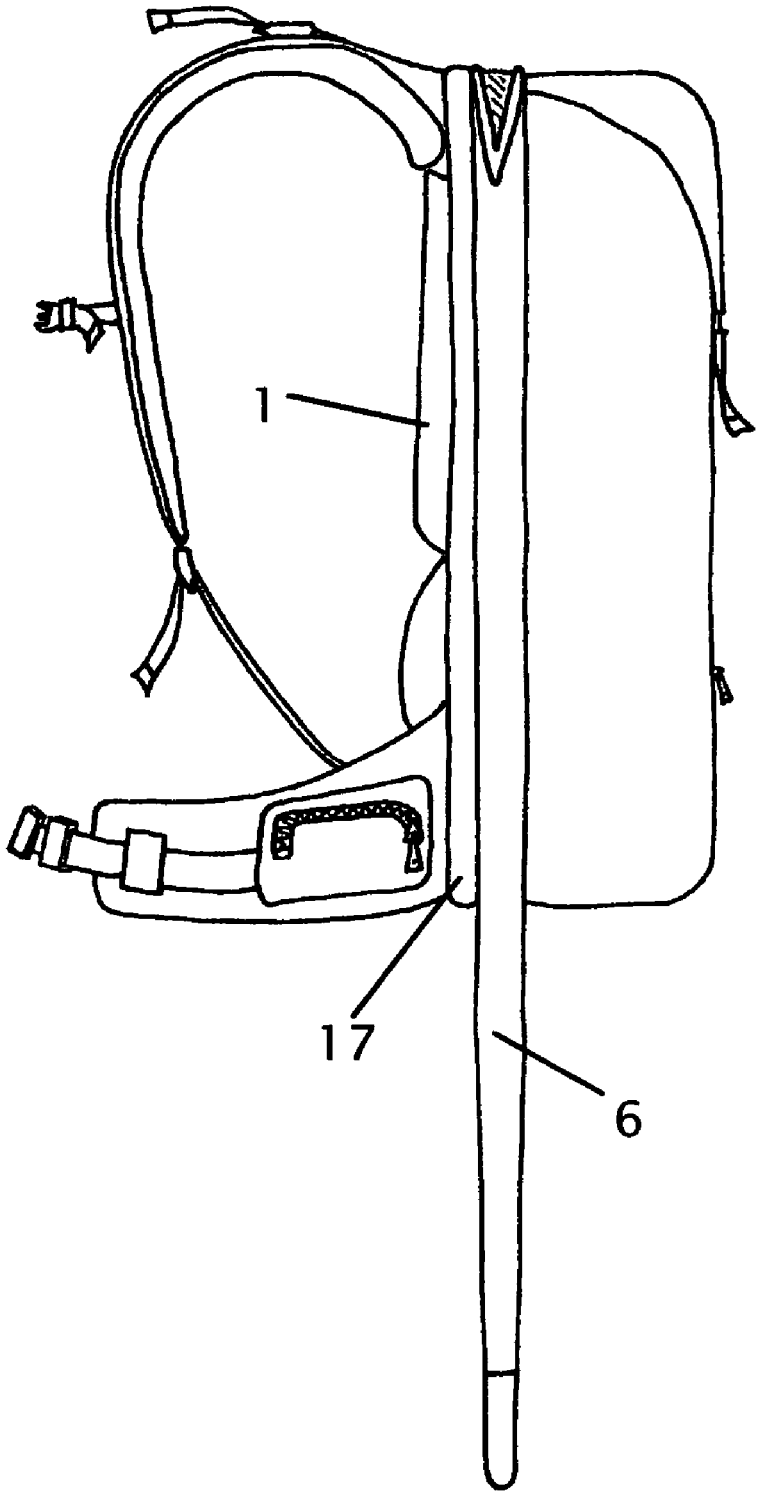
FIG. 5 is a left side profile view of a preferred embodiment of the invention.
Figure 6:
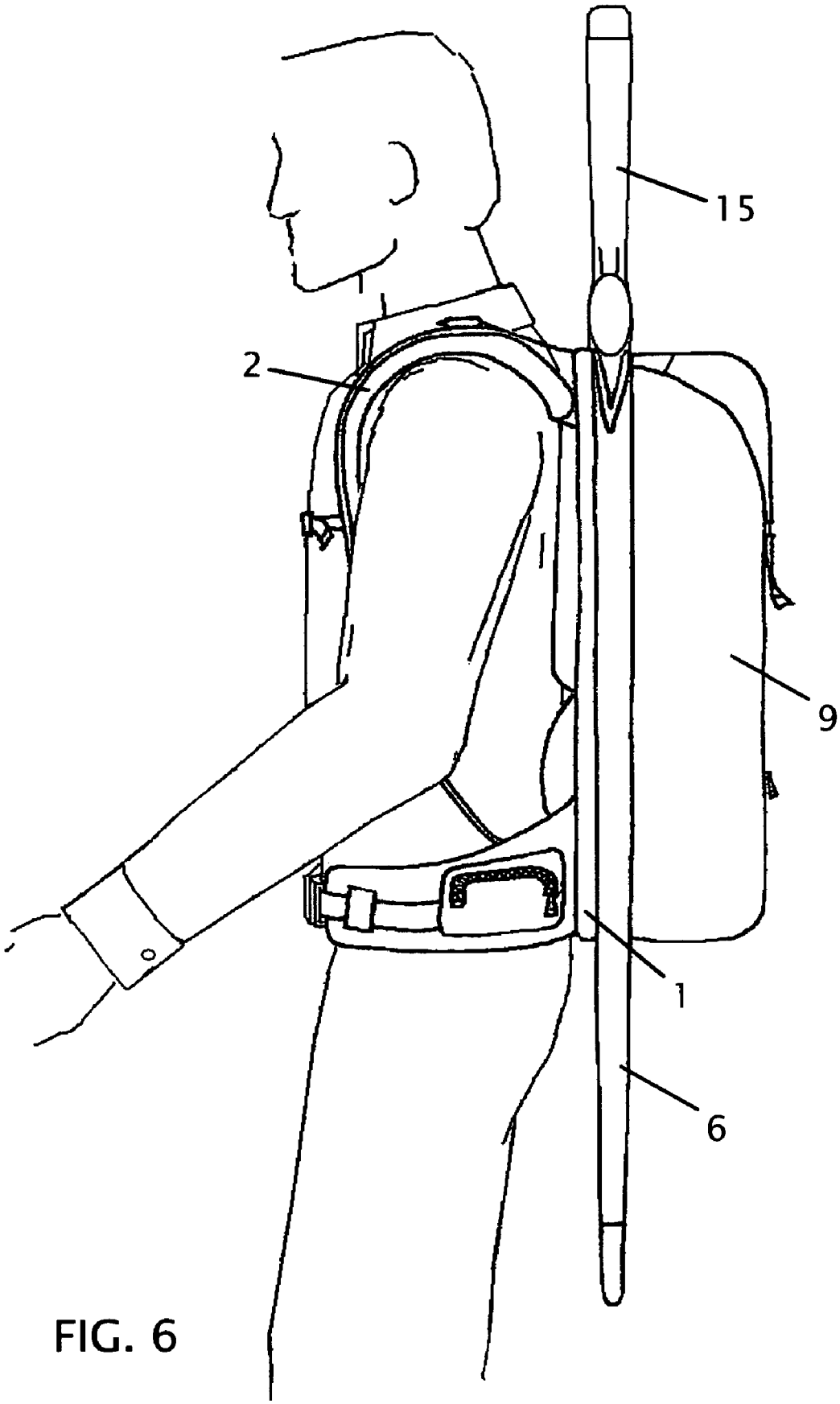
FIG. 6 is a left side profile view of a preferred embodiment of the invention, as it is worn by a user.
Figure 9:
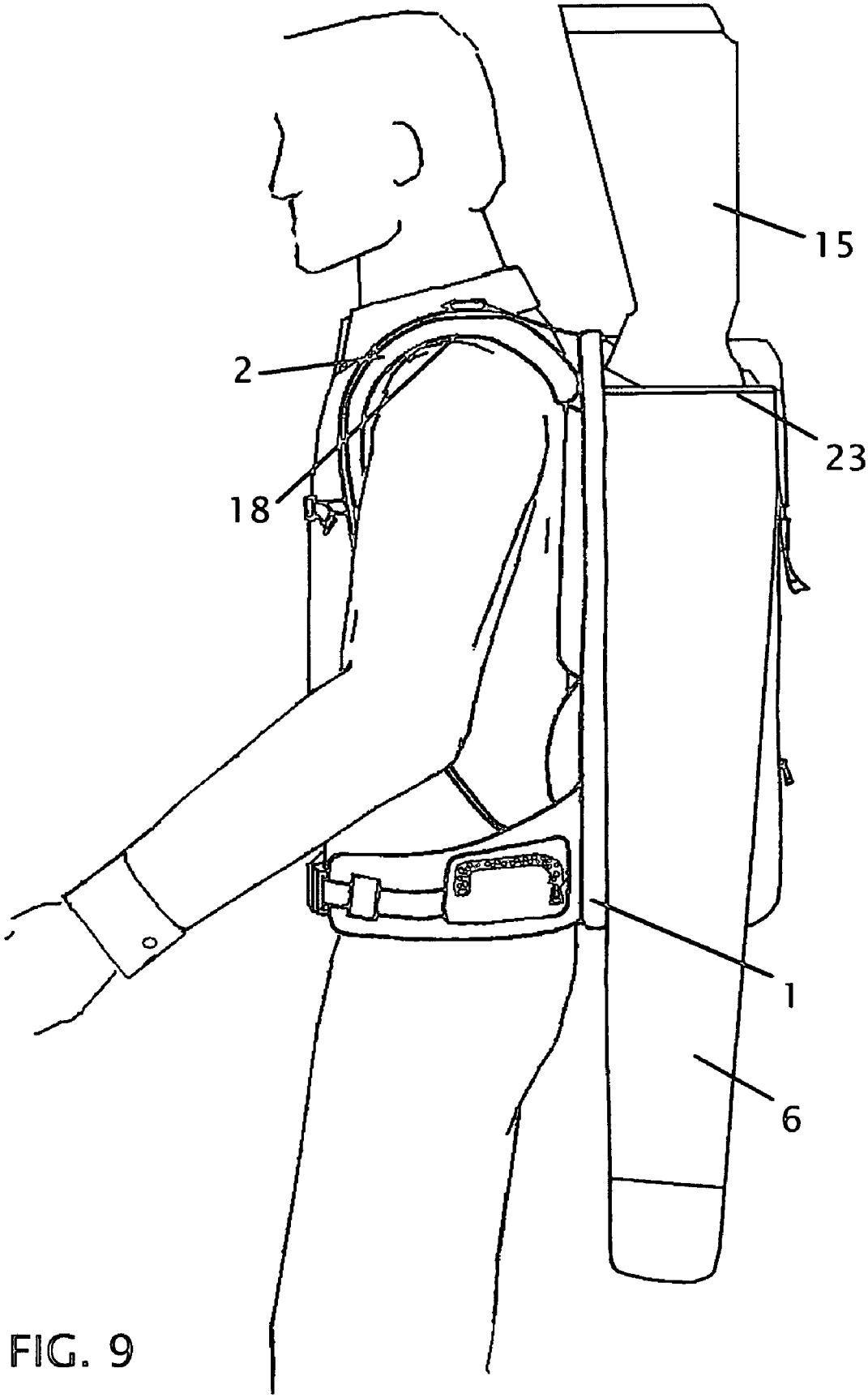
FIG. 9 is a left side profile view of the first alternative embodiment shown in FIG. 7, as it is worn by a user.

In accordance with the present invention, a backpack is provided, which is similar in styling to other backpacks designed for outdoor use, which is durable, and which has a scabbard sized for the stowage of a long gun firearm incorporated into its structure. As shown in FIG. 1, it is similar in appearance to conventional backpacks of the prior art, with the exception that the gun scabbard 6 extends below the bottom extent of the main structure. In particular, a preferred embodiment of the backpack of the present invention includes a main panel 1, generally rectangular in shape, with a front side, a back side, two edges, a top, and a bottom, which in a preferred embodiment is padded in the areas in which it will contact a wearer's back, such padding being well known and commonly used in the prior art. A shoulder harness, with two shoulder straps 2 is provided, which in a preferred embodiment is padded such as is common with prior art backpacks designed for carriage of heavier loads. This may be provided with an adjustable chest strap 3, which is a feature common to load bearing backpacks of the prior art and facilitates lateral adjustment of said shoulder straps. Likewise, adjustable straps 4 extending from the top region of the shoulder strap 2 to the top region of the main panel 1 may be provided in order to provide the user a means of further adjusting the way in which the load of the backpack is borne upon one's back. The positioning of these shoulder straps on the main panel of the backpack is important. As shown in FIG. 5, the strap should be fashioned and attached such that the inner side of the arc described by the top of the strap where it will pass over the wearer's shoulders is approximately level with the top of the main panel 1 and the top of the scabbard 6. As shown in FIG. 9, the level of the top 23 of the scabbard 6 can be made lower than the inner side 18 of the arc of the strap, and this relationship may otherwise be varied to facilitate the housing and withdrawal of different types of firearms. The intent of the positioning of the scabbard relative to the arc of the shoulder straps is to emplace a firearm such that it can be grasped and withdrawn from the scabbard by a user that is wearing the backpack. This relative positioning of a firearm is affected by the orientation of the top of the scabbard, the axis of installation of the scabbard within the pack, and by the overall length of the scabbard. Other relative positionings of the various described components that accomplish this are meant to be embraced by this disclosure.

In the preferred embodiment, a waist strap 5 is provided in order to transfer a portion of the load of the backpack to the user's hips, as is common with load bearing backpacks in the prior art. This waist belt is similar to the best waist belts available to the art, with a sandwich construction of heavy nylon or like fabric which is foam filled, and ideally should be wider nearest the main panel of the backpack, and which should taper as it extends forward around the wearer's hips or waist, toward a releasable and adjustable clasp, which again is common to the art.

Figure 3:
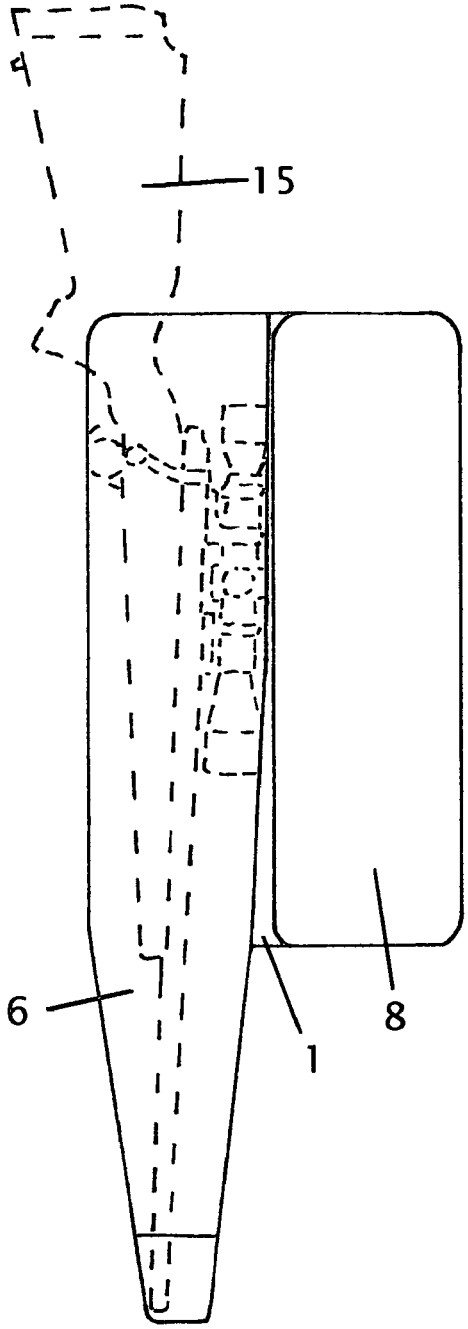
FIG. 3 is a sectional frontal plan view, showing the approximate storage volume relationship of a rifle in the scabbard, plus the adjacent area in the first described storage compartment, as well as the positioning of a rifle in a preferred embodiment.
Figure 4:
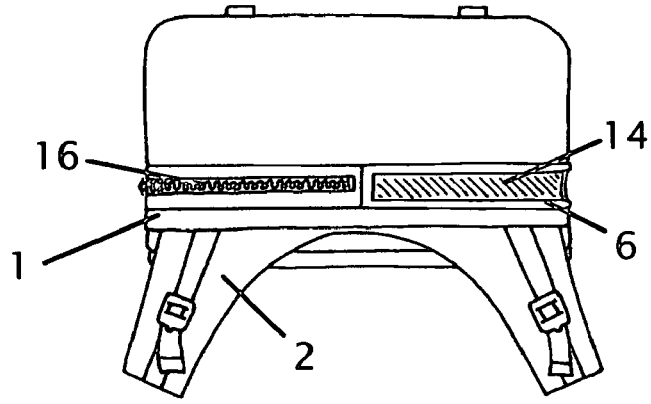
FIG. 4 is a top view of a preferred embodiment of the invention.
Figure 10:
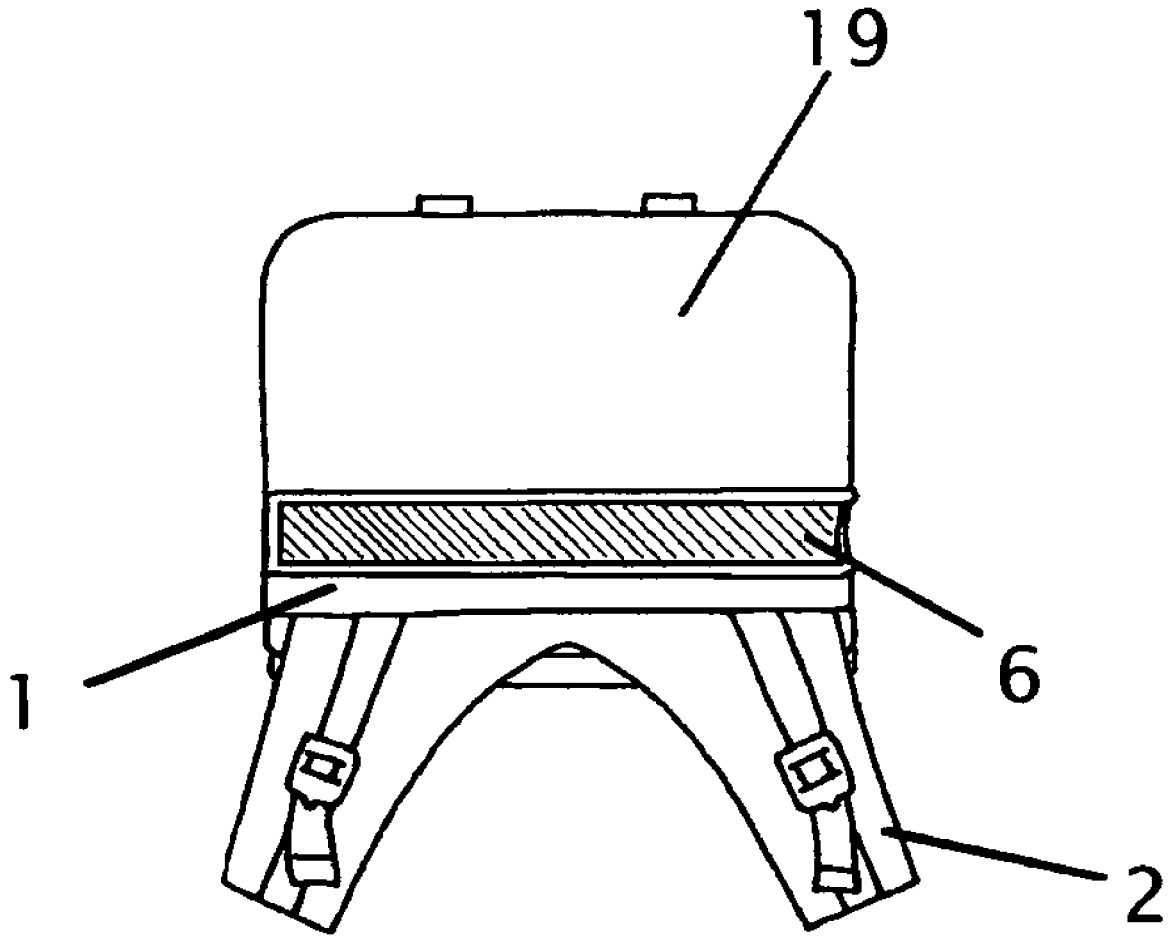
FIG. 10 is a top view of a second alternative embodiment of the invention.
Figure 11:
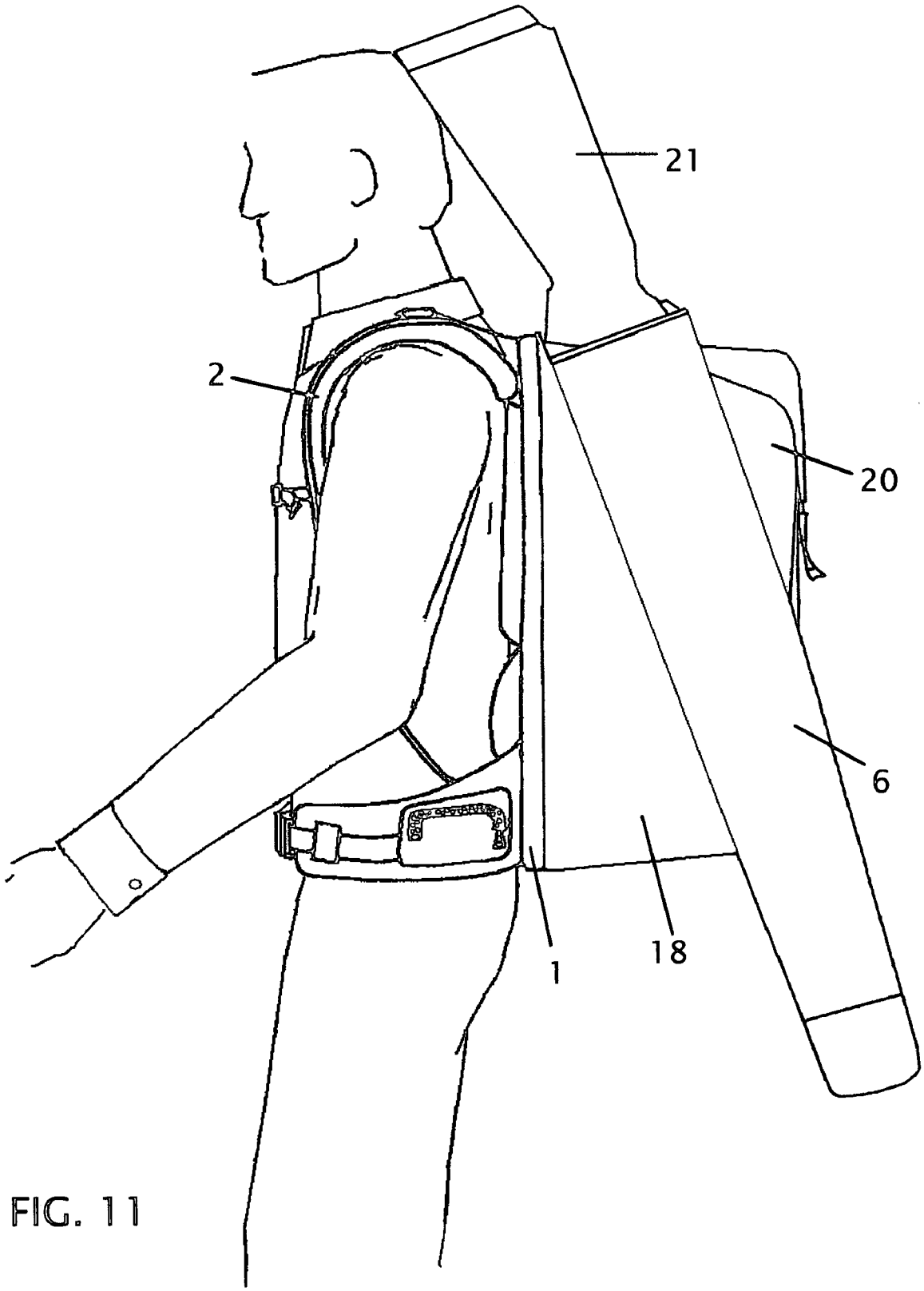
FIG. 11 is a left side profile view of a third alternative embodiment of the invention, as it is worn by a user.

The storage containers of the invention are of two varieties. Firstly, a gun scabbard 6 is provided, the orientation of which, in a preferred embodiment, is best seen in FIGS. 3, 4, and 5, with alternative embodiments shown in FIGS. 7, 8, 9, and 11. It may be laterally offset to one side or the other as shown in FIG. 3, which will place a gun that is being carried in closer proximity to one or the other of the user's arms, or it may be centrally located, with storage containers flanking it on both sides. In an alternative embodiment shown in FIG. 10, the scabbard 6 fills the majority of the lateral space of the main panel 1 and has at least one storage compartment 19 overlaid. As is common with gun scabbards, which are known and widely used, the scabbard provided in the present invention is a long, tapered receptacle with an interior space sized such that it will stow a variety of long or bulky objects such as firearms 15, including scoped rifles, rifles without scopes, shotguns, and the like. This said scabbard can be constructed of many suitable materials that are known to the prior art of gun cases and scabbards, and in the preferred embodiment is fixedly attached to the front side of the main panel 1 of the backpack. In an alternative embodiment, this scabbard may be removably attached in the same location with a system of releasable clips, or zippers, or the like. The backpack may be further configured such that a relatively shallow structure intervenes between the scabbard and the main panel. This structure can be a rigid frame, as is commonly used on load carrying backpacks, or it may be in the form of cargo storage compartments. Any intervening structure can not cause the placement of the scabbard to be too far away from the main panel, so that a firearm that is being carried in the scabbard can still be grasped and withdrawn by the wearer of the backpack. The properties of the scabbard necessary to the function of the present invention are that it preferably should be of a semi-rigid, yet still pliable construction. This can be achieved by making each of its panels of two layers of a heavy-duty nylon type fabric, with a thin layer of dense closed-cell foam, open-cell foam, or similar material sandwiched between the layers. On one or more panels, preferably the narrower side panels, additional stiffness may be achieved by inserting a thin plastic batten between the nylon layers, or by sewing heavy nylon webbing to the outer layer. In order to fit symmetrically within the interior structure of a larger backpack, this scabbard will preferably be of a four-sided construction with an open top 14 as shown in FIG. 4. This open top may have a v-shaped slot extending down the outer side panel, thus permitting some flexibility to the overall structure. This is desirable due to the irregular shape of typical long guns, and further provides a shaped slot where the pistol grip of a rifle would be snugly held. An alternative three sided scabbard of the sort widely used elsewhere, or a flat, expandable, two sided envelope, may be suitable. Ideally, a protective cover 7, made of leather or like material, is provided for the end of the scabbard where it may come into contact with obstacles the user is passing over. Now referring to FIG. 11, in some configurations it is useful to introduce a wedge shaped structure 18 between the scabbard 6 and the main panel 1 of the backpack. This wedge can be contrived such that the volume of space that it consumes can be used as a cargo storage compartment, of the type common to the art and elsewhere described. The wedge should be oriented such that its broad end is near the bottom of the backpack, tapering toward the top, thereby causing the scabbard to converge toward the main panel at its upward extent. With the opening of the scabbard near the top edge of the main panel, and the bottom of the scabbard held away from the bottom of the main panel, the buttstock 21 of a firearm will angle forward over a user's shoulder. Of primary concern in positioning the scabbard within the overall structure of the backpack is the necessity of having a firearm within arm's reach. This is accomplished by locating the top opening of the scabbard as close as possible to the main panel of the backpack, and adjusting the overall length of the scabbard such that a portion of a firearm that is being carried will protrude sufficiently so as to be grasped by a user wearing the pack. Of lesser importance is the axial orientation of the scabbard. In alternative embodiments, as shown in FIGS. 7, 8, 9, and 11, the scabbard is rotated in the vertical axis, thereby freeing more of the area adjacent the main panel for the installation of standard cargo compartments. The scabbard may be positioned with variations in other axes that may be beneficial to the overall usefulness of the backpack, such as canting it as shown in FIG. 11, or otherwise rotating its position, and these variations are meant to be encompassed by this disclosure.

Figure 7:
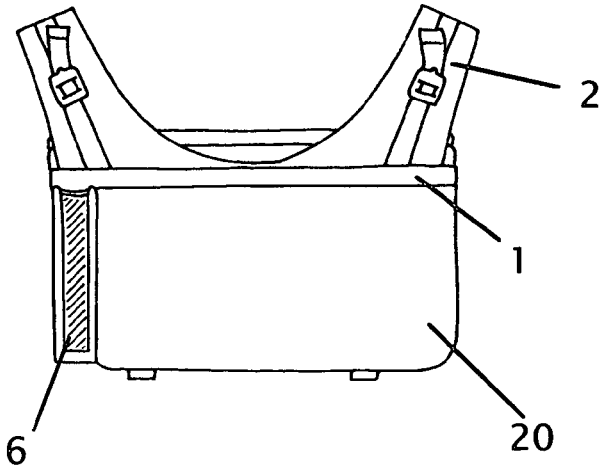
FIG. 7 is a top view of a first alternative embodiment of the invention.
Figure 8:
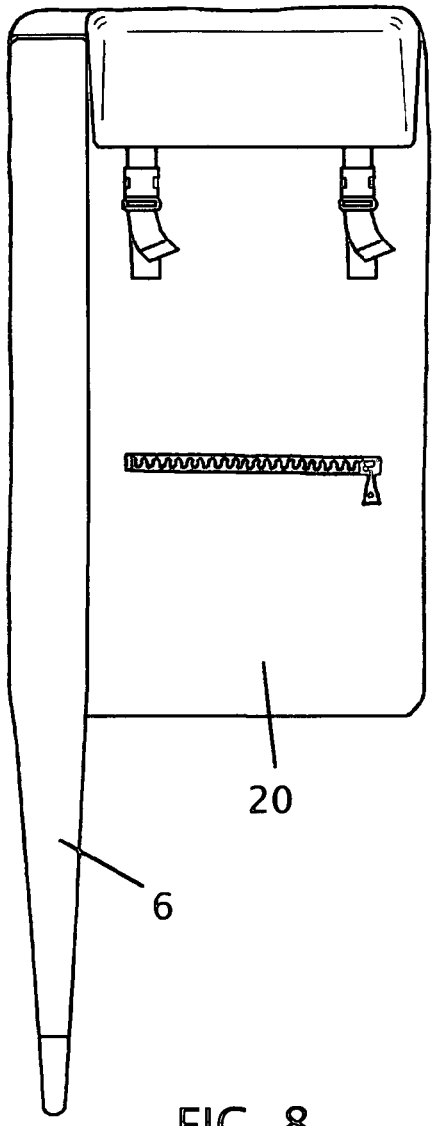
FIG. 8 is a front view of the first alternative embodiment shown in FIG. 7.

The second type of storage container is made of nylon fabric or like material, is generally six sided, and sewn together to form an interior volume of space in a fashion that is common to the prior art. In a preferred embodiment, there will be more than one of these containers, of varying sizes and shapes, arranged so as to efficiently fill all of the available storage space around and about the aforementioned scabbard. These storage containers, devised for the purpose of carrying sundry cargo, will each have at least one aperture with a selectively releasable closure. The present preferred embodiment as seen in FIGS. 1 through 6 shows a first storage compartment 8, which is best seen in FIGS. 1 and 3, positioned next to the gun scabbard 6. This compartment fills approximately the same volume of space adjacent to the main panel 1 as the gun scabbard, and the two are of like thickness. This thinner compartment may be sized to stow a water bladder, first aid supplies, or like objects which can best be stored in a thin compartment. As in FIG. 4, an opening 16 near the top may be more suitable if this container is meant to carry a water bladder. The present preferred embodiment also discloses a larger storage container 9, which is similar to storage containers common to the prior art, and ideally is constructed of nylon fabric or like material. It includes a top flap 10 with adjustable and selectively releasable closures 11, plus a zippered aperture 12 for access to the lower regions of the container. Two small storage containers 13 are added to the waist belt. As best seen in FIGS. 7, 8, and 11, alternative embodiments may be useful, wherein the large outer storage compartment 9 is not attached, and the first storage compartment 8 is replaced with storage compartment 20, of similar construction to storage compartment 9, with a volume that comprises the majority of the cargo storage capacity of the backpack. A second alternative embodiment shown in FIG. 10 provides storage compartment 19, which again is a standard backpack compartment similar in construction to storage compartment 9. All of these cargo storage compartments can be further internally subdivided, as is common to the art.

As shown in FIG. 5, it may be desirable to provide an intervening structure 17 between the main panel 1 of the backpack and the various storage containers. This structure can serve to add additional stiffness and overall strength to the backpack, and would generally have similar construction to standard external frames of aluminum tubing, or molded resin, or the like, which are common to the prior art. It can readily be seen that whereas the described main panel of the backpack serves as a foundation to which the various components of the backpack are attached, an external backpack frame is likewise a foundation to which various components of a backpack are attached, and it is intended that variations that substitute one of these foundations for the other are to be encompassed by this disclosure.

The illustrations and the present description of the invention are illustrative only, for purposes of explaining and disclosing the invention. Since numerous modifications and changes will readily occur to those skilled in the art, it is not desired to limit the invention to the exact construction shown and described, and accordingly all modifications and equivalents may be regarded as falling within the scope of the invention. Other forms that employ the present invention and serve the purposes described herein are meant to be encompassed by this disclosure.

I claim:

1. A backpack comprising, in combination:

a main panel having a top, a bottom, two side edges, a front side, and a rear side;

a shoulder harness, attached to the main panel such that it permits the main panel to be worn on a user's back, with said shoulder harness configured to hold said main panel top at the approximate level of a user's shoulders;

a gun scabbard, attached in a planar orientation proximal the front side of the main panel, said scabbard having an elongated shape, and having an interior space sized suitably for the storage of long barreled firearms, and having an open top for the insertion and extraction of said firearms, with said scabbard having a top approximately level with said main panel top, and accessible for over the shoulder removal of a gun from said scabbard;

a storage container attached proximal the front side of the main panel, said storage container having a front side, a rear side, a left side, a right side, a top side, and a bottom side, these sides forming a container with an interior space, this container having an access aperture which is fitted with a zipper or some such similar selectively releasable device with said storage container being contiguous with said scabbard.

2. The backpack of claim 1 wherein the shoulder harness is comprised of a load bearing portion of a load bearing vest or other garment.

3. The backpack of claim 1 wherein the scabbard is attached adjacent one side edge or the other side edge of the main panel.

4. The backpack of claim 1 fitted with a rigid frame, of metal tubing, or molded resin, or like construction, said frame intervening between the main panel and the shoulder harness, and either fixedly or removably attached to both of these.

5. The backpack of claim 1 wherein the main panel is comprised of a rigid frame, of metal tubing, or molded resin, or like construction.

6. The backpack of claim 1 wherein the nearest distance between the top of the main panel and the scabbard is lesser than the nearest distance between the bottom of the main panel and the scabbard.

7. The backpack of claim 1 wherein the nearest distance between the top of the main panel and the scabbard is lesser than the nearest distance between the bottom of the main panel and the scabbard.

8. The backpack of claim 1 in which said storage container comprises one or more sub-compartments of equal depth as said scabbard, with said sub-compartment positioned adjacent to and parallel to said scabbard and adjacent to said front side of said main panel, with said sub-compartments and said scabbard together being equal in width as said storage compartment.

9. The backpack of claim 8 in which said scabbard is positioned intermediate to two of said sub-compartments.

10. The backpack of claim 1 in which said scabbard is positioned adjacent to said main panel and oriented in an angle up to 90 degrees from planar.

11. The backpack of claim 1 in which said scabbard includes a slit on a side on an upper region of said scabbard, for easier removal of said gun.

12. The backpack of claim 1 which further includes a protective cover for covering an end of said scabbard from obstacles.

13. A backpack comprising, in combination:

a main panel having a top, a bottom, two side edges, a front side, and a rear side;

a shoulder harness, attached to the main panel such that it permits the main panel to be worn on a user's back, with said shoulder harness configured to hold said main panel top at the approximate level of a user's shoulders;

a gun scabbard, attached in a planar orientation and proximal the front side of the main panel, said gun scabbard having a front side and a rear side, and having an elongated shape, and having an interior space sized suitably for the storage of long barreled firearms, and having an open top for the insertion and extraction of said firearms, with said scabbard having a top approximately level with said main panel top, and accessible for over the shoulder removal of a gun from said scabbard;

a storage container attached proximal the front side of the gun scabbard and emcompassing said gun scabbard, said storage container having a front side, a rear side, a left side, a right side, a top side, and a bottom side, these sides forming a generally rectangular approximately the same height and width as said main panel, with said main panel forming said front side of said storage container with an interior space, this container having one of more access apertures which is fitted with a zipper or some such similar selectively releasable device.

14. The backpack of claim 13 wherein the shoulder harness is comprised of a load bearing portion of a load bearing vest or other garment.

15. The backpack of claim 13 wherein the main panel is comprised of the rear side of the scabbard.

16. The backpack of claim 13 fitted with a rigid frame, of metal tubing, or molded resin, or like construction, said frame intervening between the main panel and the shoulder harness, and either fixedly or removably attached to both of these.

17. The backpack of claim 13 wherein the main panel is comprised of a rigid frame, of metal tubing, or molded resin, or like construction.

* * * * *

UNITED STATES PATENT AND TRADEMARK OFFICE

CERTIFICATE OF CORRECTION

PATENT NO. : 7,654,426 B2
APPLICATION NO. : 10/894293
DATED : February 2, 2010
INVENTOR(S) : Glen Richard Eberle It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1050 days.

Signed and Sealed this

Twenty-third Day of November, 2010

David J. Kappos

David J. Kappos
*Director of the United States Patent and Trademark Office*